US009608308B2

(12) United States Patent
Song et al.

(10) Patent No.: US 9,608,308 B2
(45) Date of Patent: Mar. 28, 2017

(54) MATERIAL INCLUDING SIGNAL PASSING AND SIGNAL BLOCKING STRANDS

(75) Inventors: Ki Bok Song, Katy, TX (US); Eric Chen, Houston, TX (US); Hui Leng Lim, Sugar Land, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 190 days.

(21) Appl. No.: 14/352,419

(22) PCT Filed: Oct. 19, 2011

(86) PCT No.: PCT/US2011/056914

§ 371 (c)(1),
(2), (4) Date: Apr. 17, 2014

(87) PCT Pub. No.: WO2013/058749

PCT Pub. Date: Apr. 25, 2013

(65) Prior Publication Data

US 2014/0375511 A1 Dec. 25, 2014

(51) Int. Cl.

*H01Q 1/24* (2006.01)
*H01Q 1/22* (2006.01)
*H01Q 1/42* (2006.01)

(52) U.S. Cl.

CPC ..... *H01Q 1/241* (2013.01); *H01Q 1/2266* (2013.01); *H01Q 1/243* (2013.01); *H01Q 1/42* (2013.01)

(58) Field of Classification Search

CPC ..... H01Q 1/241; H01Q 1/2266; H01Q 1/243; H01Q 1/42
USPC ..... 343/702
See application file for complete search history.

(56) References Cited

U.S. PATENT DOCUMENTS 4,092,453 A * 5/1978 Jonda ..... B29C 70/04 139/420 R
5,102,727 A 4/1992 Pittman et al.
5,686,930 A * 11/1997 Brydon ..... H01Q 15/168 343/897
7,006,050 B2 * 2/2006 Aisenbrey ..... H01Q 1/364 343/791
7,348,285 B2 * 3/2008 Dhawan ..... D02G 3/38 174/107
8,155,497 B2 * 4/2012 Shtein ..... B82Y 10/00 385/101
2002/0186674 A1 12/2002 Mani et al.
2004/0057176 A1 * 3/2004 Dhawan ..... D02G 3/38 361/62
2005/0017911 A1 1/2005 Lee (Continued)

FOREIGN PATENT DOCUMENTS

CN 1314842 9/2001
CN 1363867 8/2002

(Continued)

OTHER PUBLICATIONS

Office Action, GB Application No. 1406787.0, Date: Jul. 8, 2015, pp. 1-4.

(Continued)

*Primary Examiner* — Dieu H. Duong
*Assistant Examiner* — Bamidele A Jegede
(74) *Attorney, Agent, or Firm* — HP Patent Department

(57) ABSTRACT

An antenna and a material. The material can include signal blocking strands and signal passing strands.

19 Claims, 6 Drawing Sheets

(56) References Cited

U.S. PATENT DOCUMENTS

| | | | | |
|---|---|---|---|---|
| 2005/0023656 | A1 | 2/2005 | Leedy | |
| 2006/0003624 | A1* | 1/2006 | Dow | H01L 23/3733 439/456 |
| 2006/0007059 | A1* | 1/2006 | Bell | A41D 27/085 345/55 |
| 2007/0071957 | A1* | 3/2007 | Atkins | B32B 3/10 428/292.1 |
| 2008/0303140 | A1* | 12/2008 | Ohtani | H01L 21/56 257/729 |
| 2009/0130995 | A1 | 5/2009 | Chen | |
| 2010/0056232 | A1* | 3/2010 | Lim | H04M 1/185 455/575.1 |
| 2010/0315299 | A1* | 12/2010 | Bibl | H04R 1/1033 343/702 |

FOREIGN PATENT DOCUMENTS

| | | | |
|---|---|---|---|
| CN | 1567376 | | 1/2005 |
| CN | 101227029 | | 7/2008 |
| CN | 101276743 | | 10/2008 |
| CN | 101437057 | | 5/2009 |
| CN | 101600550 | | 12/2009 |
| JP | 55068703 | | 5/1980 |
| WO | WO-2006/131810 | A2 | 12/2006 |

OTHER PUBLICATIONS

PCT Search Report and Written Opinion, Appln No. PCT/US2011/056914, Mar. 13, 2012, 8 p.

* cited by examiner

MATERIAL INCLUDING SIGNAL PASSING AND SIGNAL BLOCKING STRANDS

CROSS-REFERENCE TO RELATED APPLICATION

This application is a national stage application under 35 U.S.C. §371 of PCT/US2011/056914, filed Oct. 19, 2011.

BACKGROUND

Carbon fiber is a material consisting of fibers composed mostly of carbon atoms. The carbon atoms are bonded together in crystals that are aligned parallel to the long axis of the fiber. The crystal alignment gives the fiber high stiffness-to-volume ratio. Several thousand carbon fibers are twisted together to form a yarn.

BRIEF DESCRIPTION OF THE DRAWINGS

Some embodiments of the present disclosure are described with respect to the following figures.

DETAILED DESCRIPTION

Figure 1:
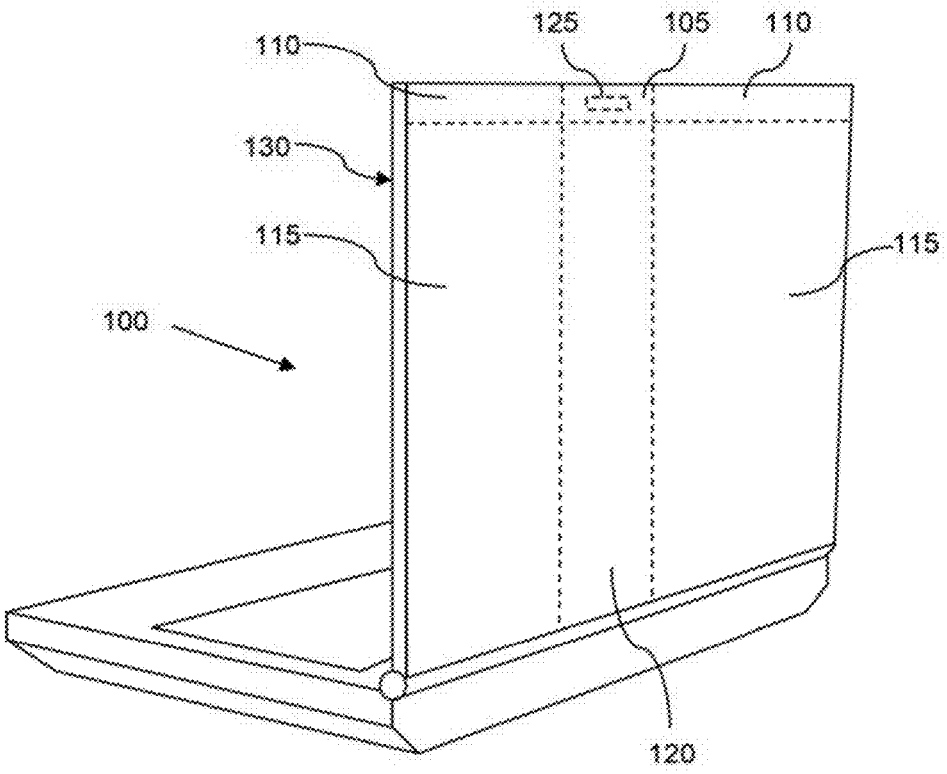
FIG. 1 is a portable computing device with a woven housing according to an example implementation.

Carbon is a conductor. A housing for a wireless antenna that includes a conductor can reflect or attenuate a signal from the antenna. This can significantly reduce the range of the signal or entirely prevent signal from transmitting through the housing. A signal blocking strand of fiber is one that interferes with a wireless signal such as carbon fibers. A signal passing strand of fiber is one that does not interfere with a wireless signal such as glass fibers (fiber glass).

Carbon fiber is a strong light weight material that can be used to create housings for portable electronic devices such as computers or phones. A portable computer or phone may have an antenna to communicate with an access point or another device. An electronic device with an antenna cannot have a completely carbon fiber housing and therefore a housing of carbon fiber may have an opening to allow the antenna signal to pass through. The opening may be covered with plastic or another material that does not block the signal.

Carbon fibers may be woven together to make a material that has a relatively high stiffness in multiple directions as compared to a woven glass fiber. A woven material that includes both carbon fibers for stiffness and glass fibers to allow wireless signals to pass can be used to create a housing for an electronic device that does not have an opening in the woven material for the antenna signals. In addition, the continuous strands of fiber may increase the stiffness of the housing. Not including an opening in the woven material that is filled in by another material such as plastic obviates a need for a coating such as paint to be applied to the housing to hide the transition of material. Not including a coating on the outside of the housing can allow the continuous pattern of the woven material to be seen on the exterior of the electronic device.

In one embodiment, a device can include a woven material including signal blocking strands and signal passing strands. A wireless antenna can be within a display housing. The housing can at least partially include the woven material. The antenna can be laterally aligned with the signal passing strands and laterally misaligned with the signal blocking strands. Laterally can mean of or relating to the side, such that viewed from the sides of the housing the antenna is aligned with the signal passing strands and not aligned with signal blocking strands.

In another embodiment, a device can include a woven material including signal blocking strands and signal passing strands. A wireless antenna can be at least partially enclosed by the woven material. The woven material may include signal block strands and signal passing strands disposed in a manner such that a majority of radiation from the antenna does not experience interference from the signal blocking strands.

In another embodiment, an electronic device can include a wireless module and an antenna connected to the wireless module. The electronic device can include a housing at least partially constructed of a woven material. The housing can include a first area in at least a portion of a radiation pattern of the signal of the antenna and a second area different than of the first area. The woven material can include signal blocking strands and signal passing strands. The first area can exclude signal blocking strands and the second area can include the signal blocking strands and the signal passing strands.

With reference to the figures, FIG. 1 is a portable computing device with a woven housing according to an example implementation. The portable computing device 100 may be for example any device with a housing 130 and an antenna 125 such as a notebook computer, a slate computer, a phone or another portable computing device.

The portable computing device 100 can include a woven material 105, 110, 115, 120. The woven material 105, 110, 115, 120 can include signal blocking strands and signal passing strands. The signal blocking strands may be made of a conductor such as carbon fiber. A housing 130 made of a conductor may reflect a signal transmitted by an antenna 125 in the housing 130 back into the housing. A housing 130 made of a conductor may reflect a signal to be received by the antenna away from the antenna. Some materials may attenuate the signal rather than reflect the signal.

In some implementations the fireless antenna 125 may be within a display housing such as the display housing of a notebook computer or slate computer. The display housing may include a display such as a liquid crystal display, organic light emitting diode display or another display technology.

The housing 130 can be made at least partially of a woven material 1, 110, 115, 120. The antenna 125 can be laterally aligned with the signal passing strands 105. The woven material can have signal passing strands aligned in different directions. The first area of the woven material 105 includes signal passing strands and not signal blocking strands. The antenna 125 can be laterally misaligned with the signal blocking strands in a second area of the woven material 110, 115, 120.

The signal blocking stands of the woven material can be oriented in different directions in the woven material. The woven material 110 can include both signal blocking strands and signal passing strands aligned in different directions, for example the signal passing strands may be perpendicular to the signal blocking strands. The woven material 120 can include both signal blocking strands and signal passing strands aligned in different directions, for example the signal passing strands may be perpendicular to the signal blocking strands. The woven material 115 can include signal blocking strands and not signal passing strands.

The signal blocking strands may be stronger and stiffer than the signal passing strands. The higher the ratio of signal blocking strands to signal passing strands the higher the stiffness of the housing. Using more signal blocking strands than signal passing strands can increase the stiffness of the housing if compared to the stiffness of a housing without signal blocking strands.

The signal blocking strands can be for example carbon fiber strands. The signal passing strands can be for example glass fibers. Carbon fiber strands can have a tensile modulus of 33 million pounds per square inch (MSI) while a S-Glass fiber has a tensile modulus 12.5. S-Glass can contain magnesia, alumina, and silicate. Aluminum has a tensile modulus of 10 and titanium has 15. Tensile modulus can be used as an indicator of the stiffness of a part. Tensile modulus is the applied tensile stress, based on the force and cross-sectional area, divided by the observed strain at that stress level. It is constant before the material approaches the point at which permanent deformation will begin to occur. It is observed as the slope of the stress-strain curve prior to the yield point.

Specific tensile modulus can be the stiffness to weight ratio of a given material determined by dividing the tensile modulus by its specific gravity of 1.8 for carbon fiber and 2.49 for S-Glass fiber. Carbon fiber has a specific tensile modulus of 18.3 while S-Glass fiber has a specific tensile modulus of 5. Aluminum has a specific tensile modulus of 3.7 and Titanium is 3.25. Carbon fiber may provide a stiffer housing while also providing a lighter chassis when compared to materials such as S-glass fiber, it and titanium. A woven material that provides the stiffness and weights of Carbon Fiber and the signal passing ability of glass fibers will result in a device housing that is fighter and stiffer than a housing made out of all glass fiber while still allowing wireless antennas to communicate through the housing.

The portable computer device may include a wireless module such as a wireless local area network (WLAN) module including for example Bluetooth and Wireless Fidelity (WIFI), a wide area network module including for example Global System for Mobile Communication (GSM) Code Division Multiple Access (CDMA), or another wireless module. The antenna 125 can be connected to the wireless module. The antenna 125 can have a radiation pattern. The radiation pattern of the antenna can be laterally aligned with the first area of the woven material 105 including signal passing strands.

Figure 2A:
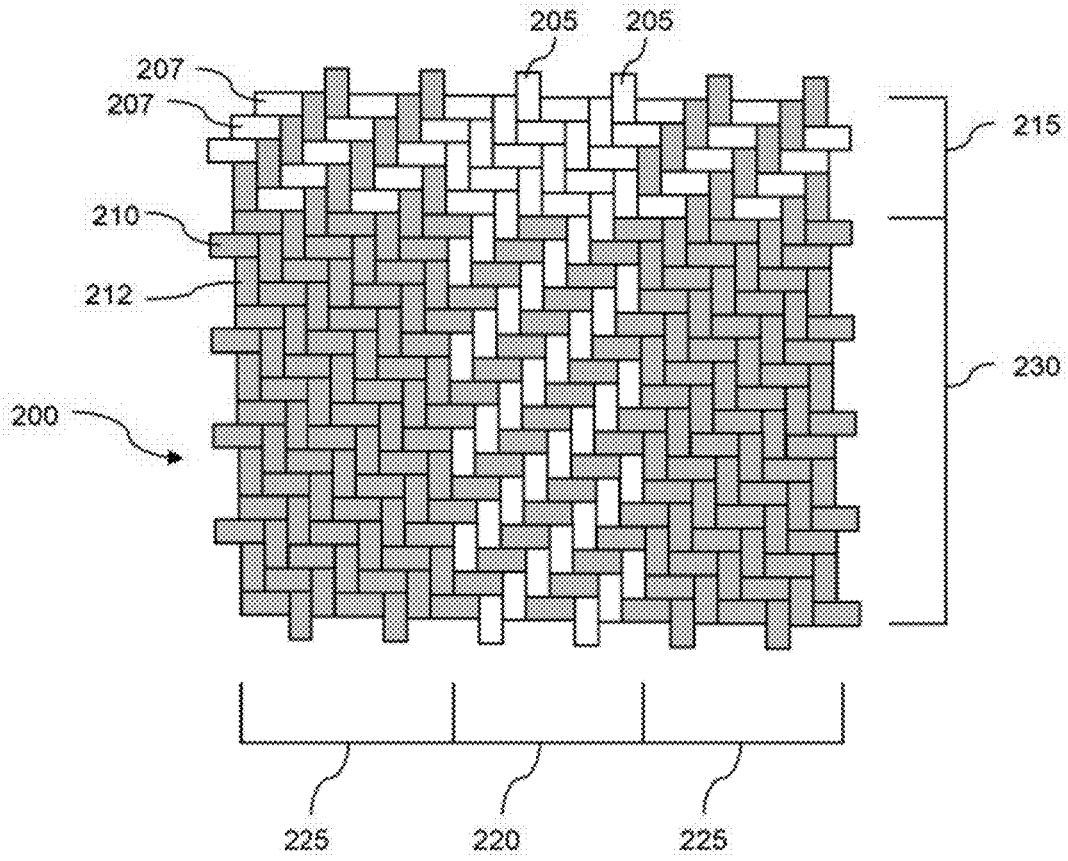
FIG. 2*a* is a woven material according to an example implementation.

FIG. 2*a* is a woven material 200 according to an example implementation. The woven material includes vertical signal passing strands 205 and horizontal signal passing strands 207. The signal passing strands 205 and 207 are shown in white to distinguish from the signal block strands in the figure but may be any color including the same color as the signal blocking strands. The woven material includes vertical signal blocking strands 212 and horizontal signal blocking strands 210. The signal blocking strands are shown in grey to distinguish from the signal passing strands in the figure.

The area 225 of the woven material includes vertical signal blocking strands 212. The area 225 overlaps with area 215 including horizontal signal passing strands 207 and area 230 including horizontal signal blocking strands 210. Area 220 including vertical signal passing strands 205 overlaps with area 215 including horizontal signal passing strands 207 and area 230 including horizontal signal blocking strands 210. The overlap of area 228 including vertical signal passing strands 205 and area 215 including horizontal signal passing strands 207 creates an area where there are no signal blocking strands. The area of no signal blocking strands (intersection of area 220 and 215) can be aligned with an antenna so that the antenna can send and receive signals through the woven material 200.

Figure 2B:
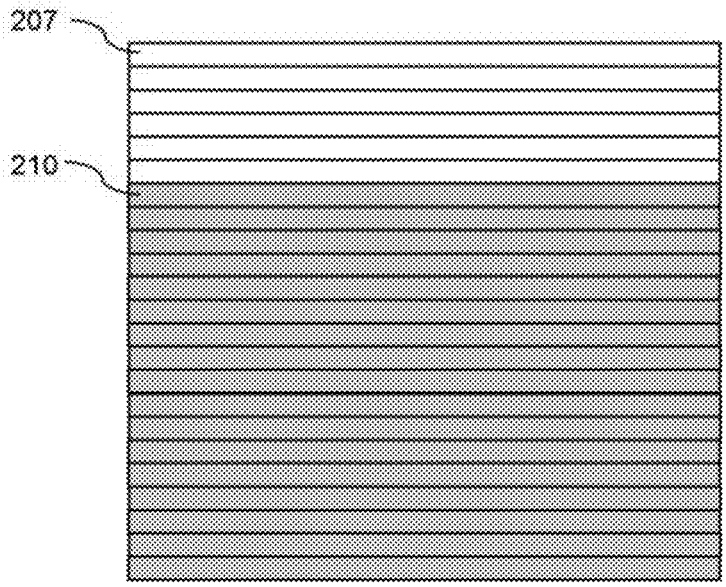
FIG. 2*b* is a unidirectional material according to an example implementation.

FIG. 2*b* is a unidirectional material according to an example implementation. The unidirectional material includes horizontal signal passing strands 207 and horizontal signal blocking strands 210. The unidirectional material may be layered with the woven material. The horizontal signal passing strands 207 of the unidirectional material can be aligned with area 215 of the woven material so that each layer will pass the signal from at antenna.

Figure 2C:
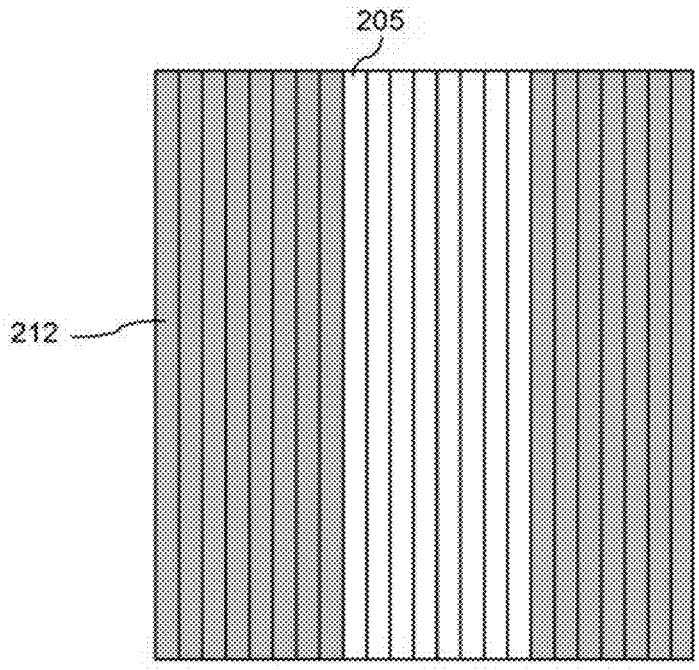
FIG. 2*c* is a unidirectional material according to an example implementation.

FIG. 2*c* is a unidirectional material according to an example implementation. The unidirectional material includes vertical signal passing strands 205 and vertical signal blocking strands 212. The unidirectional material may be layered with the woven material. The vertical signal passing strands 205 of the unidirectional material can be aligned with area 220 of the woven material so that each layer will pass the signal from at antenna. In the context of the description of the woven and unidirectional materials the terms vertical and horizontal are used for ease of description of a first direction and a second direction of the strands and are not intended to limit the description to directions in relation to gravity.

Figure 3:
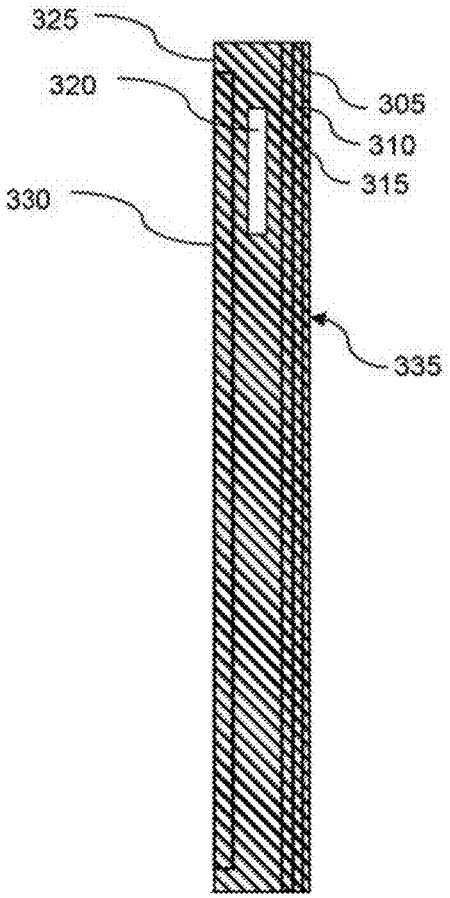
FIG. 3 is a cross section of layers of material according to an example implementation.

FIG. 3 is a cross section of layers of material according to an example implementation. The cross section can be of, for example, a display housing 325 of a device. The display housing may include a display 330 disposed on a front side of the display housing 325 and woven material disposed on a back side 335 of the housing 325.

The back side 335 of housing 325 may include multiple layers of material. For demonstration purposes, the multiple layers can include a first layer 305, a second layer 310, and a third layer 315, but may include any number of layers. At least one layer may be made of the signal blocking strands and the signal passing strands which are woven together to create a woven material. Consequently, the first layer 305 may be a woven material. Multiple layers may be made of a woven material.

Some layers may be made of fibers, either signal passing strands and/or signal blocking strands that are unidirectional. The unidirectional arranged fibers all go in one direction rather than be woven from strands in multiple directions. For example the second layer 310 may be a unidirectional arranged layer of fibers. The unidirectional arranged layer of fibers may include signal blocking strands and signal passing strands. Multiple layers may give the housing a stiffness that a single layer cannot provide however each layer has to have an area that allows the signal to pass through.

The multiple layers can be bound together by a resin. The resin may be an epoxy, plastic, glue or another material.

Figure 4:
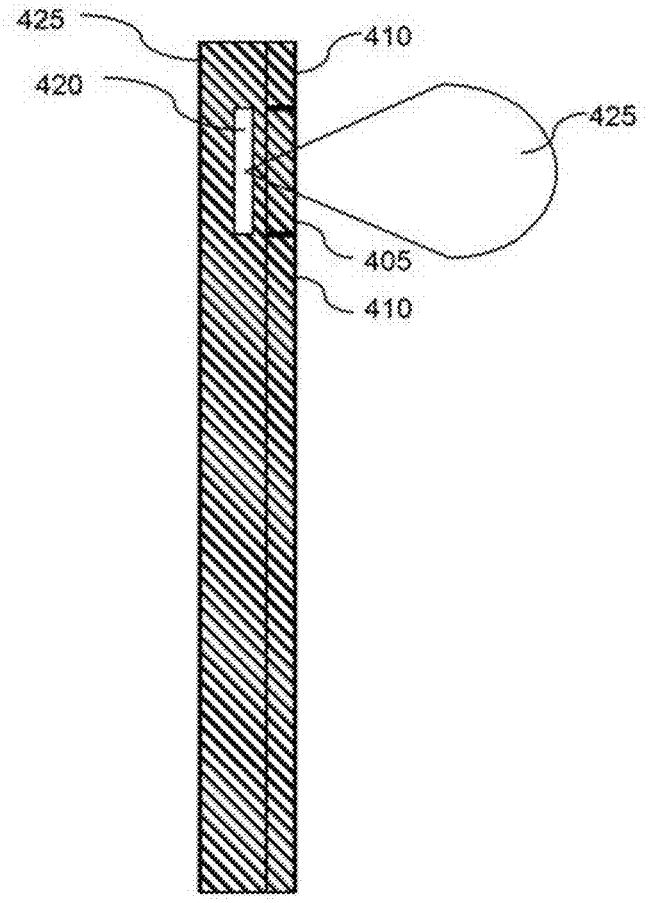
FIG. 4 is an example of a radiation pattern of an antenna according to an example implementation.

FIG. 4 is an example of a radiation pattern of an antenna according to an example implementation. The cross section can be of for example a housing 425 of a device. The housing 425 can include a woven material 405 and 410 including signal blocking strands and signal passing strands. A wireless antenna can be at least partially enclosed by the woven material 405 and 410. In the illustrated example, the woven material 410 includes signal blocking strands while the woven material 405 does not include signal blocking strands and includes signal passing strands.

An antenna 420 has a radiation pattern 425 such as the example one depicted. The majority of a radiation pattern 425 of the antenna 420 does not include an area of the woven material including signal blocking strands, such as area 410. Rather, the majority of the radiation pattern 425 of the antenna 420 passes through the woven material not including signal blocking strands such as 405. This allows the device such as a portable computing device to have a housing of increased stiffness compared to a housing made without signal blocking strands. The portable computing device can be one of a laptop, a slate and a phone.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A device comprising:

a housing comprising a plurality of layers of material, a first layer of the plurality of layers comprising a woven material including signal blocking strands and signal passing strands, and a second layer of the plurality of layers comprising unidirectional strands that extend along a single direction, wherein the second layer is without any signal strands that extend in a direction different from the single direction; and a wireless antenna within the housing, wherein the antenna is laterally aligned with the signal passing strands and is laterally misaligned with the signal blocking strands.

2. The device of claim 1, wherein the signal blocking strands are carbon fibers.

3. The device of claim 1, wherein the signal passing strands are glass fibers.

4. The device of claim 1, further comprising a display in the housing.

5. The device of claim 4, wherein an opening in the housing for the display is on a front side of the housing and the first layer comprising the woven material is on a back side of the housing opposite the front side.

6. The device of claim 1, wherein the woven material includes more of the signal blocking strands than the signal passing strands.

7. The device of claim 1, wherein the unidirectional strands in the second layer comprise unidirectional signal blocking strands extending along the single direction, and unidirectional signal passing strands extending along the single direction.

8. The device of claim 7, wherein a third layer of the plurality of layers includes unidirectional signal blocking strands and unidirectional signal passing strands, wherein the unidirectional signal blocking strands and the unidirectional signal passing strands of the second layer extend in a direction different from the single direction that is of the unidirectional signal blocking strands and the unidirectional signal passing strands of the third layer.

9. The device of claim 1, further comprising a resin to bind the plurality of layers.

10. The device of claim 1, wherein a third layer of the plurality of layers comprises a woven material.

11. A method of forming a device, comprising:

binding a plurality of layers to form a housing, the plurality of layers including a first layer comprising a woven material including signal blocking strands and signal passing strands, and a second layer comprising unidirectional signal blocking strands that extend along a first direction and unidirectional signal passing strands that extend along the first direction, wherein the second layer is without any signal strands that extend in a direction different from the first direction; and arranging a wireless antenna in the housing, wherein the antenna is positioned such that a radiation pattern passes through an area of the woven material without signal blocking strands.

12. The device of claim 1, wherein the device is a portable computing device.

13. The device of claim 12, wherein the portable computing device is one of a laptop, a slate, and a phone.

14. An electronic device comprising:

a wireless module;

an antenna connected to the wireless module;

a housing including a plurality of layers, a first layer of the plurality of layers comprising a woven material, a first area in at least a portion of a radiation pattern of the antenna, and a second area different than the first area, wherein the woven material includes signal blocking strands and signal passing strands, wherein the first area excludes signal blocking strands, and the second area includes the signal blocking strands and the signal passing strands, and wherein a second layer of the plurality of layers includes unidirectional strands that extend along a single direction, wherein the second layer is without any signal strands that extend in a direction different from the single direction.

15. The method of claim 11, wherein the plurality of layers include a third layer comprising unidirectional signal blocking strands and unidirectional signal passing strands that extend along a second direction perpendicular to the first direction.

16. The method of claim 11, wherein the area of the woven material that is without signal blocking strands comprises signal passing strands.

17. The electronic device of claim 14, wherein the unidirectional strands comprise unidirectional signal blocking strands and unidirectional signal passing strands.

18. The electronic device of claim 14, wherein the signal blocking strands are carbon fibers.

19. The electronic device of claim 14, wherein the signal passing strands are glass fibers.

* * * * *